US005568667A

United States Patent [19]

Brown

[11] Patent Number: 5,568,667

[45] Date of Patent: Oct. 29, 1996

[54] STRUCTURE TO INTERCONNECT TWO BRANCHES OF A SUSPENSION BRIDGE FRAMEWORK IN CORRESPONDENCE OF A PIER SUPPORTING THE CATENARY

[75] Inventor: William Brown, Kensington Highst, United Kingdom

[73] Assignee: Stretto Di Messina S.p.A., Rome, Italy

[21] Appl. No.: 428,084

[22] PCT Filed: Oct. 27, 1993

[86] PCT No.: PCT/EP93/02987

§ 371 Date: May 26, 1995

§ 102(e) Date: May 26, 1995

[87] PCT Pub. No.: WO94/10388

PCT Pub. Date: May 11, 1994

[30] Foreign Application Priority Data

Oct. 28, 1992 [IT] Italy ..... MI92A2468

[51] Int. Cl.[6] ..... E01D 2/04; E01D 19/02

[52] U.S. Cl. ..... 14/20; 14/73; 14/74.5; 14/75

[58] Field of Search ..... 14/18, 19, 20, 14/21, 73, 75, 5, 10, 78, 74.5

[56] References Cited

U.S. PATENT DOCUMENTS 4,741,063 5/1988 Diana ..... 14/18

5,400,454 3/1995 Cunningham ..... 14/18 X

*Primary Examiner*—Tamara L. Graysay

*Assistant Examiner*—James A. Lisehora

*Attorney, Agent, or Firm*—Young & Thompson

[57] ABSTRACT

A suspension bridge having end piers from which the bridge is suspended. The bridge has a substantially fixed stiff horizontal branch (P1) and a substantially flexible horizontal branch (P2). Each bridge branch (P1, P2) comprises three parallel longitudinally extending mutually spaced box-like bodies comprising a central body (S1) and two lateral bodies (S2, S3). Transverse ledgers (T) are located at regular intervals along the bridge and interconnect the three bodies. There is a gap between the two bridge branches (P1, P2) and in the gap there is a central body section (S1') fixedly interconnecting the central longitudinal bodies (S1) of the two bridge branches (P1, P2). Also in the gap there are two lateral body sections (S") extending between and slidable relative to the lateral bodies (S2, S3) of the two bridge branches (P1, P2). A vertical hinge joint, also in the gap, interconnects the bridge branches (P1, P2) and lies on the central longitudinal axis of the bridge.

6 Claims, 2 Drawing Sheets

STRUCTURE TO INTERCONNECT TWO BRANCHES OF A SUSPENSION BRIDGE FRAMEWORK IN CORRESPONDENCE OF A PIER SUPPORTING THE CATENARY

FIELD OF THE INVENTION

The present invention concerns suspension bridges comprising an essentially flat main structure, or framework, the top surface of which forms the roadway for the transport means crossing the bridge, and a suspension system formed of catenary cables anchored to end piers of the bridge and of a plurality of vertical stays or hangers to suspend the bridge framework to the catenary cables.

BACKGROUND OF THE INVENTION

As known, these suspension bridges are highly exposed to winds, the effects of which have to be taken into account—in many respects—when planning the bridge. The present invention particularly concerns the effects produced by crosswind pressure, which tends to cause a horizontal inflection of the bridge framework, thereby creating remarkable stresses especially in correspondence of the point of anchorage of said framework to the end piers supporting the bridge.

It is also known, in fact, that this area of the bridge framework is subject to stresses, which become higher—on the one hand—the wider the span of the bridge, and—on the other hand—the longer the distance of the bridge lateral edges from its central axis.

In a bridge—for instance like that described in EP-A-0, 233,528, filed by the same Applicant—having a span wider than 3 Km and a transversal verse dimension of about 50 m, the stresses in correspondence of the point of anchorage of the framework to the end piers can become inadmissible.

Hereinafter, reference is made to a bridge framework formed of a fixed stiff branch—corresponding to the framework part extending from the pier axis towards the embankment—and of a flexible branch, corresponding to the framework part extending from the pier axis towards the central bay. Of course, this assumption is quite arbitrary since, in real fact, no part of the bridge framework can be considered totally fixed and stiff; nevertheless, it helps to better understand the invention and define its contents in a conventional way.

OBJECT OF THE INVENTION

The object of the present invention is to thus propose a structure to interconnect two branches—a substantially fixed stiff branch and a substantially flexible branch—of a suspension bridge framework, in correspondence of the end piers supporting the bridge, said structure allowing to substantially reduce the stresses determined by horizontal inflection.

SUMMARY OF THE INVENTION

This result is obtained—in a bridge framework, wherein each of said branches comprises three parallel longitudinal, mutually spaced, box-like bodies, a central body for railway traffic and two lateral bodies for roadway traffic, said bodies being interconnected by transverse ledgers positioned at regular intervals along the bridge—due to the fact that said structure comprises: a central body section forming a fixed joint between the central longitudinal bodies of the two bridge branches; two lateral body sections mounted slidable in respect of the lateral longitudinal bodies of the two bridge branches; and a hinge joint between said bridge branches, in correspondence of the pier axis.

The invention is based on the consideration that, when a bridge is overstressed by horizontal inflection, it is possible to annul the over-stressing effects by interrupting the solution of continuity in correspondence of the end piers supporting the bridge, and providing for a hinge system—instead of a fixed joint—to prevent the horizontal inflection of the bridge from being transmitted to the end piers.

On the other hand, to allow railway traffic to take place in safe conditions, it is necessary to preserve the continuity of the horizontal rotation of the bridge at least in correspondence of the railway traffic lane.

These contrasting requirements are now in fact brilliantly solved by the present invention, according to which the continuity is preserved for the central longitudinal body of the bridge—designed for railway traffic and, besides, also less subject to stresses—while a hinge system is provided for the lateral sections of the bridge, designed for roadway traffic.

BRIEF DESCRIPTION

Further characteristics and advantages of the interconnecting structure according to the present invention will anyhow be more evident from the following detailed description of a preferred embodiment thereof, given by way of example and illustrated on the accompanying drawings, in which:

FIG. 1 is a diagrammatic plan view of the suspension bridge framework, work, in correspondence of its point of anchorage to an end pier; and FIG. 2 is a section view along the line II—II of FIG. 1.

DETAILED DESCRIPTION OF THE PREFERRED EMBODIMENT

As shown on the drawings, the bridge framework is formed of three parallel longitudinal, mutually spaced, box-like bodies—a central body S1 and two lateral bodies S2 and S3—interconnected by transverse ledgers T positioned at regular intervals along the bridge, as described more in detail in another patent application being simultaneously filed by the same Applicant.

Figure 1:
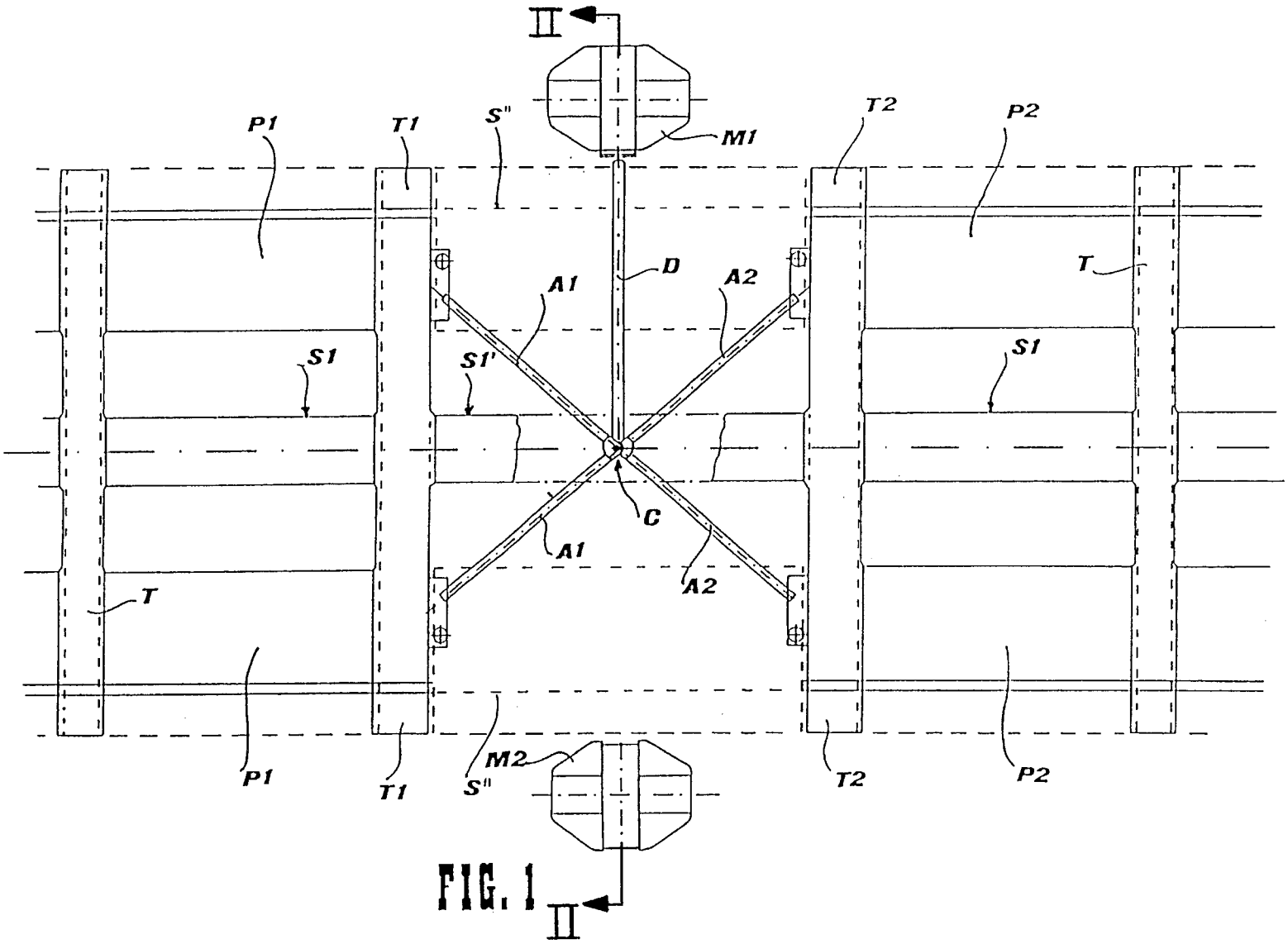

It is evident from FIG. 1 that, in correspondence of the end piers—each comprising two pillars M1 and M2—the fixed stiff branch P1 of the bridge terminates with the ledger T1, while the flexible branch P2 of the bridge terminates with the ledger T2. Between these ledgers T1 and T2 there is a central section of the bridge framework which forms the interconnecting structure between the two branches P1 and P2.

Said ledgers T1 and T2 form first of all the base of two triangles, the oblique sides of which are formed by a pair of beams A1 and, respectively, A2; these latter converge at the centre on the vertical axis of the pier, which is also the hingeing axis of said two triangles.

On said hingeing axis there is provided a hinge pin C, onto which is articulated a transverse rod D, the other end of which is articulated to the side of the pillar M1 (see also FIG. 2), preferably by way of a ball joint.

Figure 2:
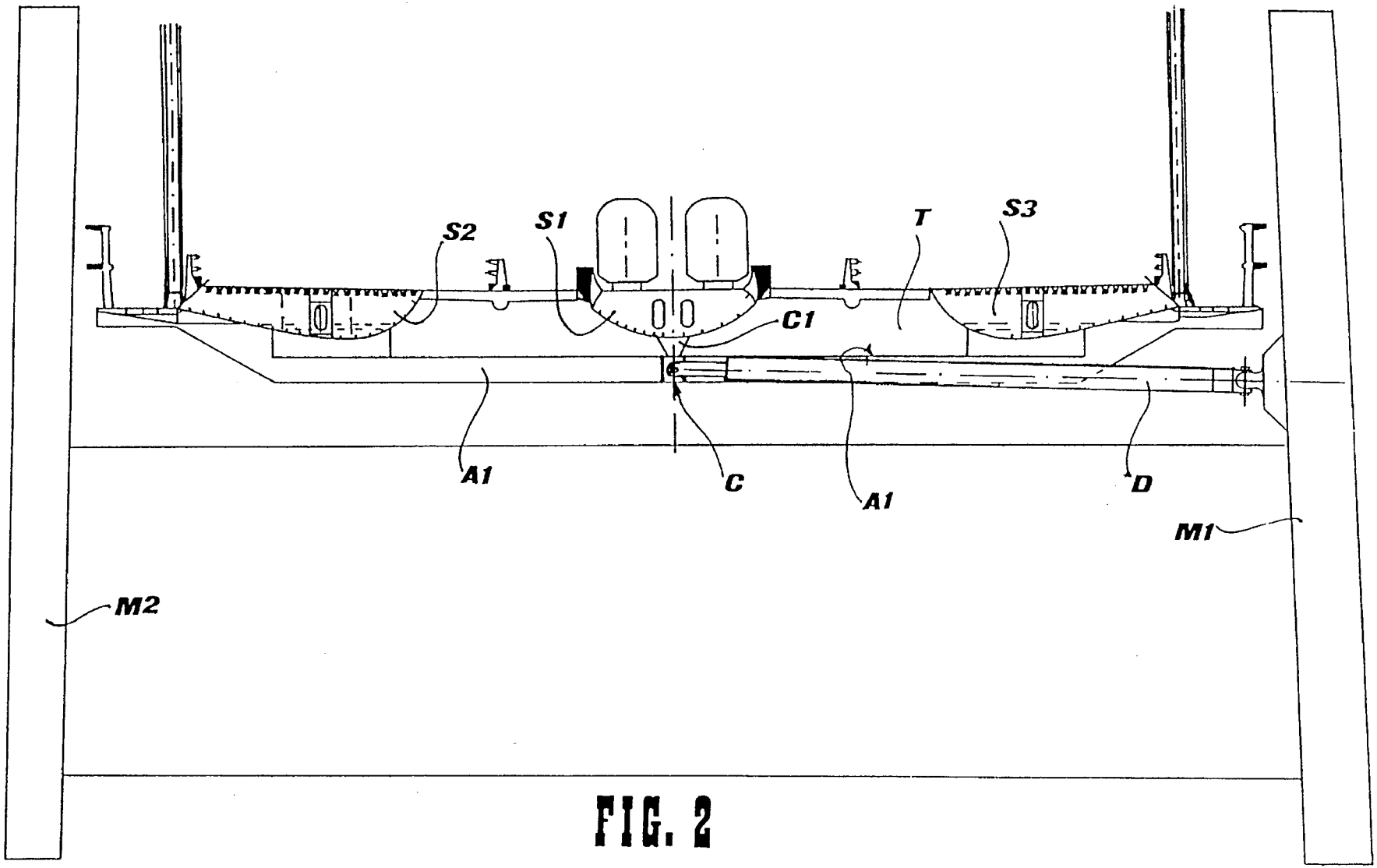

In the area of the interconnecting structure above said two triangles—and according to the fundamental characteristic of the present invention—there are positioned:

a central box-like body S1', which forms a continuation of both central longitudinal bodies S1 of the flexible branch P2 and, respectively, of the fixed stiff branch P1 of the bridge; this body S1' also forms what is defined as a fixed joint between said two bodies S1; as can be seen from FIG. 2, the hinge pin C is carried by an anchor base C1 projecting from the bottom of the body S1';

two lateral box-like bodies S", which are mounted slidable in respect of the lateral longitudinal bodies S2 and S3 of the branches P1 and P2 of the bridge; this slidable assembly of the bodies S", together with the hinge assembly of the ledgers T1 and T2 on the pin C, form what is defined as a hinge joint between the branches P1 and P2 of the bridge.

As can be easily seen from the drawings, the fixed joint and the described hinge joint can be considered to coincide with the vertical axis of the pier. Hence, the ledger T2 of the flexible branch P2 of the bridge can "rotate" sideways even considerably, under crosswind pressure, without causing any stresses on the lateral bodies S2 and S3 of the bridge (roadway traffic lanes), while the inflection undergone by the central body S1–S1' (railway traffic) has very limited effects, since this section is positioned close to the central symmetry axis of the bridge where there are no stresses.

This fixed and hinge joint system is completed by the spacing rod D, which—as already said—is meant to prevent impact between the pier and the bridge framework, for instance due to oscillations or movements caused by wind pressures or seismic actions. Thanks to its articulation at both ends, the rod D produces no strains on the structure.

It is to be understood that the invention is not limited to the particular embodiment described heretofore, which only forms a very schematic and non-limiting example thereof, but that several embodiments are possible, all within reach of an expert of the art, without thereby departing from the scope of the invention itself.

I claim:

1. A suspension bridge having end piers from which a bridge is suspended, the bridge comprising a substantially fixed stiff horizontal branch (P1) and a substantially flexible horizontal branch (P2), each bridge branch (P1, P2) comprising three horizontal parallel longitudinally extending mutually spaced box-like bodies comprising a central body (S1) and two lateral bodies (S2, S3), transverse ledgers (T) located at regular intervals along the bridge and interconnecting said bodies, there being a gap between the two bridge branches (P1, P2) and in the gap there being a central body section (S1') fixedly interconnecting the central longitudinal bodies (S1) of the two bridge branches (P1, P2); also in the gap there being two lateral body sections (S") extending between and slidable relative to said lateral bodies (S2, S3) of the two bridge branches (P1, P2); and in the gap a vertical hinge joint interconnecting said bridge branches (P1, P2) and lying on a central longitudinal axis of the bridge.

2. A bridge as claimed in claim 1, each of said three longitudinal box-like bodies (S1, S2, S3) comprising a traffic lane of the bridge, said central bodies (S1) of both of said branches and said central body section (S1') comprising a continuous stiff structure extending along the two branches (P1, P2) of the bridge.

3. A bridge as claimed in claim 2, wherein said continuous stiff structure (S1, S1') supports a railway traffic lane.

4. A bridge as claimed in claim 1, wherein said central body section (S1') carries at its center a downwardly projecting anchor base (C1) to which is connected a pin (C) comprising a part of said hinge joint and defining said axis.

5. A bridge as claimed in claim 1, and a pair of beams (A1, A2) secured at one end to spaced points along each of two said ledgers (T1, T2), one of said two ledgers (T1) being secured to said stiff branch (P1) and the other of said two ledgers (T2) being secured to said flexible branch (P2), said beams converging on and being secured to said hinge joint.

6. A bridge as claimed in claim 5, further comprising a transverse spacing rod (D) articulated at one end to a said pier and at another end to said hinge joint.

* * * * *